US005937447A

United States Patent [19]

Howell

[11] Patent Number: 5,937,447

[45] Date of Patent: Aug. 17, 1999

[54] PROTECTIVE GARMENT

[76] Inventor: William J. Howell, #9 Fletcher St., Goose Creek, S.C. 29445

[21] Appl. No.: 08/944,696

[22] Filed: Oct. 6, 1997

[51] Int. Cl.[6] ..... A41D 13/00

[52] U.S. Cl. ..... 2/463; 2/464; 2/466

[58] Field of Search ..... 2/455, 456, 462, 2/463, 464, 466, 467, 2.5, DIG. 3

[56] References Cited

U.S. PATENT DOCUMENTS

| | | | |
|---|---|---|---|
| 745,007 | 11/1903 | Gamble | 2/462 |
| 3,995,320 | 12/1976 | Zafuto | 2/463 |
| 4,453,271 | 6/1984 | Donzis | 2/456 |
| 4,481,679 | 11/1984 | Hayes | 2/463 |
| 4,866,789 | 9/1989 | Dorm | 2/462 |
| 4,884,295 | 12/1989 | Cox | 2/462 |
| 5,249,306 | 10/1993 | Morris | 2/462 |

FOREIGN PATENT DOCUMENTS

| | | | |
|---|---|---|---|
| 2272615 | 12/1975 | France | 2/464 |
| 2823370 | 12/1979 | Germany | 2/464 |

*Primary Examiner*—Michael A. Neas

[57] ABSTRACT

A protective garment is provided including a chest protector being formed of solid foam. Also included is an abdominal protector including a plurality of inflatable tubular mechanisms. The abdominal protector is connected to the chest protector. Next provided is a groin protector connected to the abdominal protector and formed of solid foam. Finally, a strap assembly is provided for securing the protectors on a user.

9 Claims, 3 Drawing Sheets

PROTECTIVE GARMENT

BACKGROUND OF THE INVENTION

1. Field of the Invention

The present invention relates to a protective garment and more particularly pertains to protecting a user with a garment formed of both inflatable and foam segments.

2. Description of the Prior Art

The use of protective vests is known in the prior art. More specifically, protective vests heretofore devised and utilized for the purpose of protecting a user against blows are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,423,087; U.S. Pat. No. 3,995,320; U.S. Pat. Des. No. 340,542; U.S. Pat. No. 5,204,993; U.S. Pat. No. 4,870,706; and U.S. Pat. No. 4,872,215.

In this respect, the protective garment according to the present invention substantially departs from the conventional concepts and designs of the prior art, and in so doing provides an apparatus primarily developed for the purpose of protecting a user with a garment formed of both inflatable and foam segments.

Therefore, it can be appreciated that there exists a continuing need for a new and improved protective garment which can be used for protecting a user with a garment formed of both inflatable and foam segments. In this regard, the present invention substantially fulfills this need.

SUMMARY OF THE INVENTION

In view of the foregoing disadvantages inherent in the known types of protective vests now present in the prior art, the present invention provides an improved protective garment. As such, the general purpose of the present invention, which will be described subsequently in greater detail, is to provide a new and improved protective garment which has all the advantages of the prior art and none of the disadvantages.

To attain this, the present invention essentially comprises a chest protector having a rectilinear configuration. As shown in the Figures, the chest protector is defined by a square front surface, a square rear surface, and a periphery formed of a top face, a bottom face, and a pair of side faces. It is imperative that the chest protector be formed of solid foam. Next provided is an abdominal protector including a flexible foam housing. Such flexible housing has a rectilinear configuration with a square front surface, a square rear surface, and a periphery defined by a top face, a bottom face, and a pair of side faces formed therebetween defining an interior space. A plurality of vertically oriented inflatable tubes are situated within the flexible housing in a side-by-side relationship. It should be noted that the housing of the abdominal protector has the top face thereof hingably coupled along the bottom face of the chest protector. Associated therewith is a pair of rib protectors each including a flexible foam housing having a rectilinear configuration. The housings each have a rectangular front surface, a rectangular rear surface, and a periphery defined by a top face, a bottom face, and a pair of side faces formed therebetween defining an interior space. Similar to the abdominal protector, the rib protectors are each equipped with a plurality of vertically oriented inflatable tubes situated therein in a side-by-side relationship. The housing of the rib protectors each have one of the side faces thereof hingably coupled along an associated one of the sides faces of the housing of the abdominal protector. A groin protector is provided that is formed of solid foam. As shown in the Figures, the groin protector has a generally inverted triangular configuration with a front surface, a rear surface and a periphery defined by a top face and a pair of side faces. The top face of the groin protector is hingably connected along the bottom face of the abdominal protector. For maintaining the present invention mounted on a user during use, a strap assembly is provided. Note FIG. 3. Such strap assembly includes a pair of vertically oriented parallel chest straps coupled to opposite ends of the top face of the chest protector. Each of the parallel chest straps are equipped with a female connector coupled to a free end thereof. Next included is a horizontally oriented first pair of parallel rib straps connected to opposite ends of one of the side faces of a first one of the rib protectors. A male connector is coupled to each of the free ends of the first pair of rib straps. A first short vertical strap is connected to a central extent of a top one of the first pair of parallel rib straps with a male connector coupled thereto. With continuing reference to FIG. 3, a horizontally oriented second pair of parallel rib straps is shown to be connected to opposite ends of one of the side faces of a second one of the rib protectors. Each of the second pair of rib straps is equipped with a female connector coupled thereto. A second short vertical strap is connected to a central extent of a top one of the second pair of parallel rib straps with a male connector coupled thereto. A third short vertical strap is shown to be coupled to a central extent of a bottom one of the second pair of parallel rib straps with a female connector coupled thereto. Finally, a vertical groin strap is connected to a bottom apex of the groin protector with a female connector coupled thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved protective garment which has all the advantages of the prior art protective vests and none of the disadvantages.

It is another object of the present invention to provide a new and improved protective garment which may be easily and efficiently manufactured and marketed.

It is a further object of the present invention to provide a new and improved protective garment which is of a durable and reliable construction.

An even further object of the present invention is to provide a new and improved protective garment which is susceptible of a low cost of manufacture with regard to both materials and labor, and which accordingly is then susceptible of low prices of sale to the consuming public, thereby making such protective garment economically available to the buying public.

Still yet another object of the present invention is to provide a new and improved protective garment which provides in the apparatuses and methods of the prior art some of the advantages thereof, while simultaneously overcoming some of the disadvantages normally associated therewith.

Still another object of the present invention is to protect a user with a garment formed of both inflatable and foam segments.

Lastly, it is an object of the present invention to provide a new and improved protective garment including a chest protector being formed of solid foam. Also included is an abdominal protector including a plurality of inflatable tubular mechanisms. The abdominal protector is connected to the chest protector. Next provided is a groin protector connected to the abdominal protector and formed of solid foam. Finally, a strap assembly is provided for securing the protectors on a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
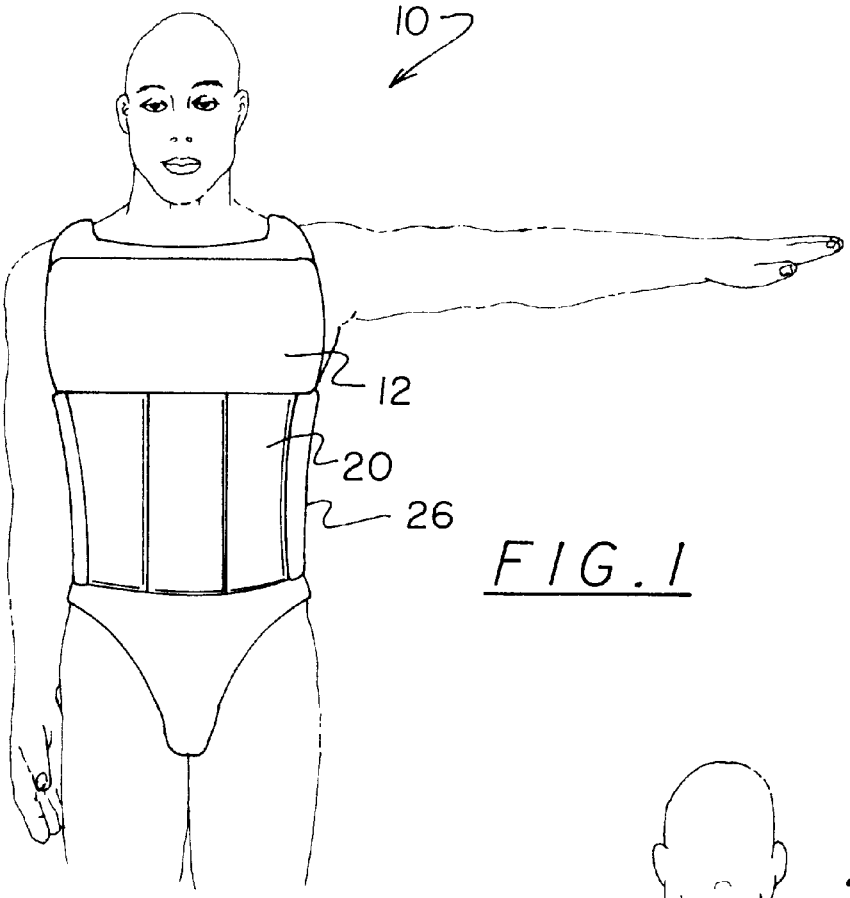
FIG. 1 is a perspective illustration of the preferred embodiment of the protective garment constructed in accordance with the principles of the present invention.
Figure 2:
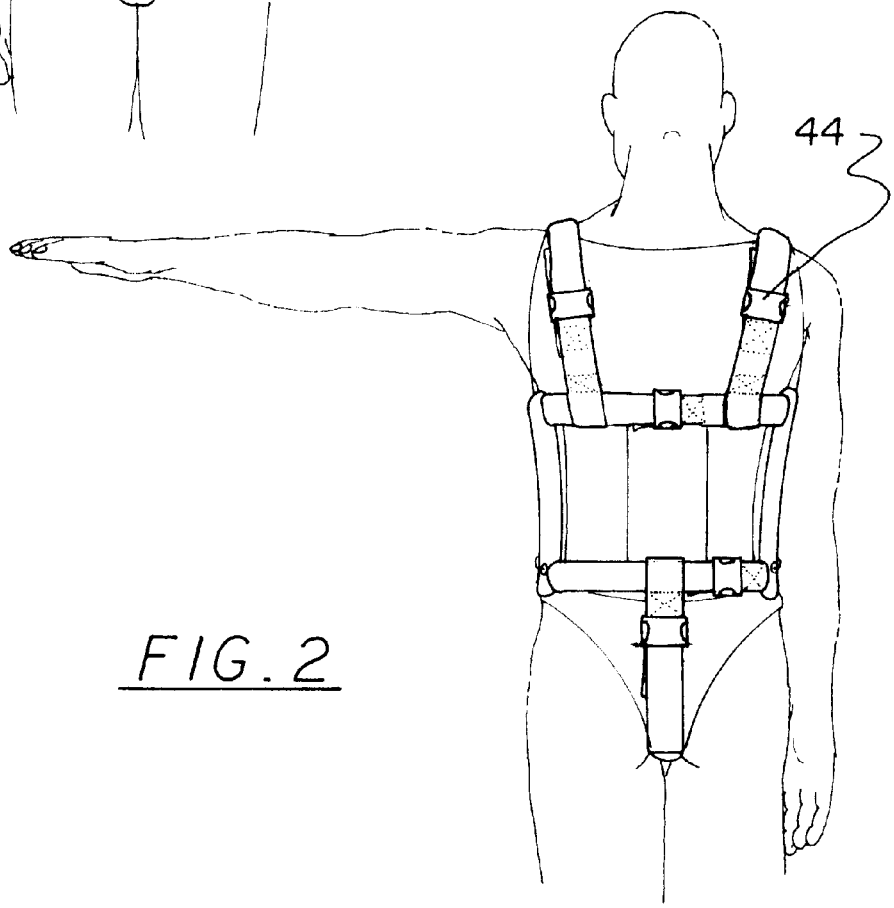
FIG. 2 is a rear view of the present invention.

With reference now to the drawings, and in particular to FIG. 1 thereof, a new and improved protective garment embodying the principles and concepts of the present invention and generally designated by the reference numeral 10 will be described.

The present invention, the new and improved protective garment, is comprised of a plurality of components. Such components in their broadest context include chest, abdominal, rib, and groin protectors and a strap assembly. Such components are individually configured and correlated with respect to each other so as to attain the desired objective.

Figure 6:
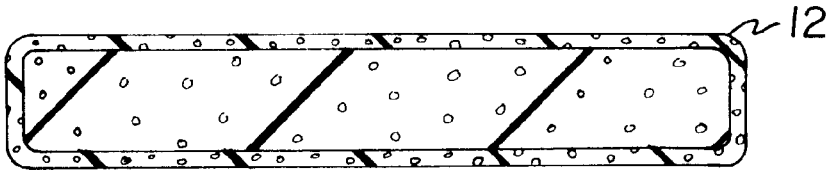
FIG. 6 is a cross-sectional view of the chest protector.

More specifically, it will be noted that the system 10 of the present invention includes a chest protector 12 having a rectilinear configuration. As shown in the Figures, the chest protector is defined by a square front surface, a square rear surface, and a periphery formed of a top face, a bottom face, and a pair of side faces. It is imperative that the chest protector be formed of solid foam. As an option, such foam may be multi-layered, as shown in FIG. 6.

Next provided is an abdominal protector 20 including a flexible foam housing 22. Such flexible housing has a rectilinear configuration with a square front surface, a square rear surface, and a periphery defined by a top face, a bottom face, and a pair of side faces formed therebetween defining an interior space. A plurality of vertically oriented inflatable tubes 24 are situated within the flexible housing in a side-by-side relationship. Such communication may be afforded by means of a plurality of small interconnect tubes. It should be noted that the housing of the abdominal protector has the top face thereof hingably coupled along the bottom face of the chest protector.

Associated therewith is a pair of rib protectors 26 each including a flexible foam housing having a rectilinear configuration. The housings each have a rectangular front surface, a rectangular rear surface, and a periphery defined by a top face, a bottom face, and a pair of side faces formed therebetween defining an interior space. Similar to the abdominal protector, the rib protectors are each equipped with a plurality of vertically oriented inflatable tubes 28 situated therein in a side-by-side relationship. The housing of the rib protectors each have one of the side faces thereof hingably coupled along an associated one of the sides faces of the housing of the abdominal protector.

Figure 4:
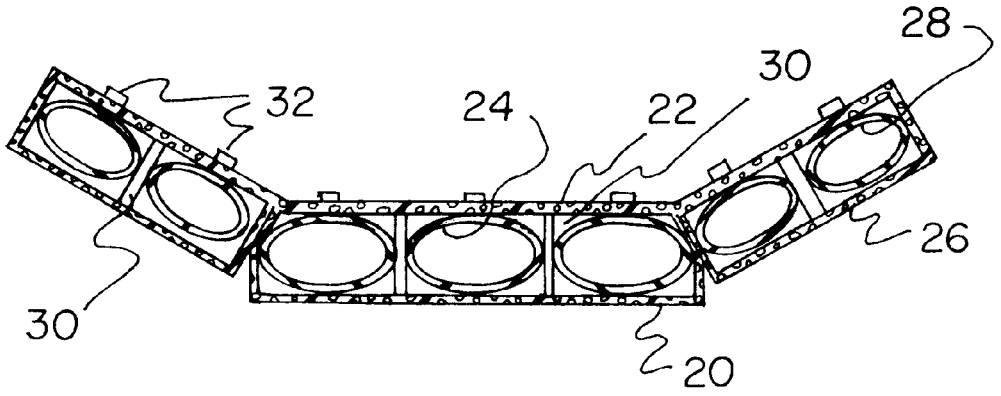
FIG. 4 is a cross-sectional view of the abdominal and rib protectors of the present invention taken along line 4—4 shown in FIG. 3.
Figure 5:
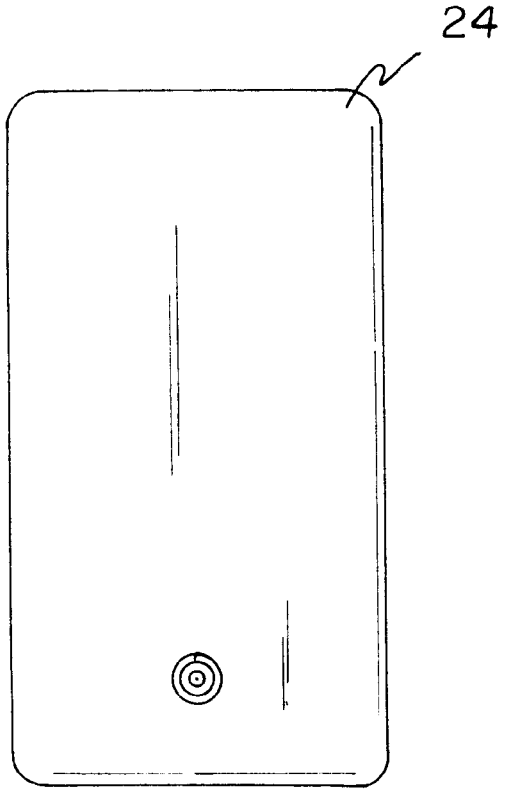
FIG. 5 is a rear view of one of the inflatable tubes of the abdominal and rib protectors.

As shown in FIG. 4, the rib and abdominal protectors each have a plurality of vertical dividing walls 30 between each of the tubes. For allowing the inflation of the tubes, a valved aperture 32 is formed in each of the tubes. Such valved apertures are accessible from the face of the associated flexible housing.

A groin protector 34 is provided that is formed of solid foam. As shown in the Figures, the groin protector has a generally inverted triangular configuration with a front surface, a rear surface and a periphery defined by a top face and a pair of side faces. The top face of the groin protector is hingably connected along the bottom face of the abdominal protector. While not shown, it should be understood that the groin and chest protectors are of a reduced thickness as compared to the rib and abdominal protectors.

For maintaining the present invention mounted on a user during use, a strap assembly 40 is provided. Note FIG. 3. Such strap assembly includes a pair of vertically oriented parallel chest straps 42 coupled to opposite ends of the top face of the chest protector. Each of the parallel chest straps is equipped with a female connector 44 coupled to a free end thereof.

Figure 3:
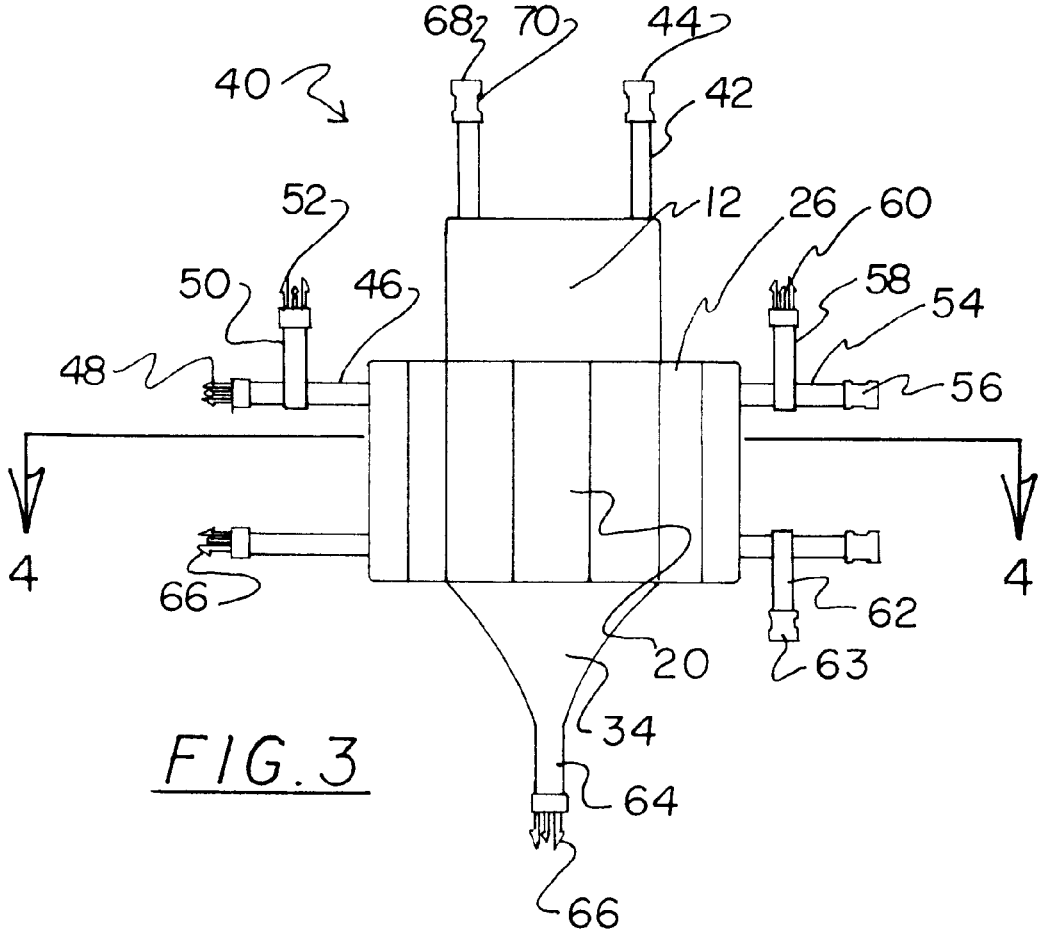
FIG. 3 is a front view of the present invention.

Next included as a component of the strap assembly is a horizontally oriented first pair of parallel rib straps 46 connected to opposite ends of one of the side faces of a first one of the rib protectors. A male connector 48 is coupled to each of the free ends of the first pair of rib straps. A first short vertical strap 50 is connected to a central extent of a top one of the first pair of parallel rib straps with a male connector 52 coupled thereto. With continuing reference to FIG. 3, a horizontally oriented second pair of parallel rib straps 54 is shown to be connected to opposite ends of one of the side faces of a second one of the rib protectors. Each of the second pair of rib straps is equipped with a female connector 56 coupled thereto. A second short vertical strap 58 is connected to a central extent of a top one of the second pair of parallel rib straps with a male connector 60 coupled thereto.

A third short vertical strap 62 is shown to be coupled to a central extent of a bottom one of the second pair of parallel rib straps with a female connector 63 coupled thereto. In the preferred embodiment, the first, second and third vertical straps are slidably coupled to the respective rib straps by way of a closed sliding loop. Finally, a vertical groin strap 64 is connected to a bottom apex of the groin protector with a female connector coupled thereto. It should be noted that each of the male connectors is equipped with a pair of biased prongs 66 adapted to be releasably situated within a sleeve 68 defined by the female connectors. Such sleeve has a pair of openings 70 formed therein for receiving the prongs of the male connectors. As an option, each pair of coupled straps may be adjustable by way of a buckle formed on the base of one of the connectors associated therewith. By such structure, the connector is adapted to be situated at various lengths along the corresponding strap.

During use, the male connectors of the first pair of parallel rib straps are releasably connected to the female connectors of the second pair of parallel rib straps. Such coupling maintains the abdominal and rib protectors in place and further prevents lateral shifting of the present invention. Further, the male connectors of the first and second short vertical straps are releasably connected to the female connectors of the pair of parallel chest straps. This coupling maintains the vertical position of the protectors. Finally, the third short vertical strap releasably connected to the male connector of the groin strap in order to maintain the groin strap in place.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. A protective garment comprising, in combination:

a chest protector having a rectilinear configuration with a square front surface, a square rear surface, and a periphery defined by a top face, a bottom face, and a pair of side faces, the chest protector being formed of solid foam;

an abdominal protector including a flexible foam housing having a rectilinear configuration with a square front surface, a square rear surface, and a periphery defined by a top face, a bottom face, and a pair of side faces formed therebetween defining an interior space with a plurality of vertically oriented inflatable tubes situated therein and situated in a side-by-side relationship, the housing of the abdominal protector having the top face thereof hingably coupled along the bottom face of the chest protector;

a pair of rib protectors each including a flexible foam housing having a rectilinear configuration with a rectangular front surface, a rectangular rear surface, and a periphery defined by a top face, a bottom face, and a pair of side faces formed therebetween defining an interior space with a plurality of vertically oriented inflatable tubes situated therein in and situated in a side-by-side relationship, the housing of the rib protectors each having one of the side faces thereof hingably coupled along an associated one of the sides faces of the housing of the abdominal protector;

a groin protector having a generally inverted triangular configuration with a front surface, a rear surface and a periphery defined by a top face and a pair of side faces, the groin protector being formed of solid foam, the top face of the groin protector hingably connected along the bottom face of the abdominal protector;

a strap assembly including a pair of vertically oriented parallel chest straps coupled to opposite ends of the top face of the chest protector each with a female connector coupled thereto, a horizontally oriented first pair of parallel rib straps connected to opposite ends of one of the side faces of a first one of the rib protectors each with a male connector coupled thereto, a first short vertical strap connected to a central extent of a top one of the first pair of parallel rib straps with a male connector coupled thereto, a horizontally oriented second pair of parallel rib straps connected to opposite ends of one of the side faces of a second one of the rib protectors each with a female connector coupled thereto, a second short vertical strap connected to a central extent of a top one of the second pair of parallel rib straps with a male connector coupled thereto, a third short vertical strap connected to a central extent of a bottom one of the second pair of parallel rib straps with a female connector coupled thereto, and a vertical groin strap connected to a bottom apex of the groin protector with a female connector coupled thereto;

said male connectors of the first pair of parallel rib straps being releasably connected to the female connectors of the second pair of parallel rib straps, the male connectors of the first and second short vertical straps releasably connected to the female connectors of the pair of parallel chest straps, and the third short vertical strap releasably connected to the male connector of the groin strap.

2. A protective garment comprising:

a chest protector being formed of solid foam;

an abdominal protector including a plurality of inflatable tubular means, the abdominal protector connected to the chest protector; and strap means for securing the chest and abdominal protectors on a user.

3. A protective garment as set forth in claim 2 wherein the abdominal protector is hingably coupled to the chest protector.

4. A protective garment as set forth in claim 2 wherein a pair of rib protectors are coupled to sides of the abdominal protector.

5. A protective garment as set forth in claim 4 wherein the rib protectors are hingably coupled to the abdominal protectors.

6. A protective garment as set forth in claim 4 wherein the rib protectors each include inflatable tubular means.

7. A protective garment as set forth in claim 2 and further including a groin protector connected to the abdominal protector.

8. A protective garment as set forth in claim 7 wherein the groin protector is formed of solid foam.

9. A protective garment comprising:

an abdominal protector including a plurality of inflatable tubular means;

a groin protector connected to the abdominal protector, the groin protector formed of solid foam; and strap means for securing the groin and abdominal protectors on a user.

* * * * *